US005190267A

United States Patent [19]

Schmitt et al.

[11] Patent Number: 5,190,267

[45] Date of Patent: Mar. 2, 1993

[54] HAND RAILING AND METHOD OF MANUFACTURE

[75] Inventors: Gervase G. Schmitt; Ronald T. Schmitt; Gervase A. Schmitt, all of Lancaster, Pa.

[73] Assignee: G. G. Schmitt & Sons, Inc., Lancaster, Pa.

[21] Appl. No.: 796,382

[22] Filed: Nov. 22, 1991

[51] Int. Cl.[5] ..... E04H 17/14

[52] U.S. Cl. ..... 256/59; 248/251; 16/111 R

[58] Field of Search ..... 256/59; 248/251; 16/111 R, DIG. 12

[56] References Cited

U.S. PATENT DOCUMENTS

| | | | |
|---|---|---|---|
| D. 185,613 | 6/1959 | Price | D90/11 |
| D. 202,335 | 9/1965 | Blum | D13/7 |
| D. 203,162 | 12/1965 | Blum | D13/7 |
| D. 210,519 | 3/1968 | Kusel | D13/7 |
| D. 292,614 | 11/1987 | Nilsson | D25/122 |
| 2,520,355 | 8/1950 | Bell | 16/111 R X |
| 2,767,959 | 10/1956 | Schott | 256/19 |
| 3,016,763 | 1/1962 | Albert | 74/551.9 |
| 3,168,170 | 2/1965 | Thom | 189/34 |
| 3,494,596 | 2/1970 | Bellinson | 256/24 |
| 3,633,862 | 1/1972 | Breen | 248/251 |
| 4,020,639 | 5/1977 | Nagare | 61/10 |
| 4,895,332 | 1/1990 | Hansen et al. | 256/59 X |

*Primary Examiner*—Andrew V. Kundrat
*Attorney, Agent, or Firm*—Larry W. Miller

[57] ABSTRACT

A rigid hand railing is disclosed having a plurality of compound indentations formed in the underside thereof to facilitate gripping thereof by a human hand. A method of manufacture of such a hand railing is also disclosed wherein a tool having a plurality of individually movable forming punches to be driven into preformed tooling stock is used to form the indentations in one side of the tubing stock. Each forming punch is provided with a tip portion having a compound shape formed from two perpendicular oriented and oppositely disposed arcuate shapes. The forming punches are to be alternatively or sequentially driven into the tubing stock to form the indentations.

14 Claims, 5 Drawing Sheets

HAND RAILING AND METHOD OF MANUFACTURE

BACKGROUND OF THE INVENTION

The present invention relates generally to hand railings and, more particularly, to a rigid hand railing having a plurality of finger-sized indentations formed in one surface thereof to facilitate gripping by human hands and to a method of manufacture of such a hand railing and a tool for use in such manufacture.

Hand railings are placed in use throughout the world to assist in related human activity. For example, stairs are typically provided with hand railings to assist people in traversing up or down the stairs. Swimming pools are equipped with hand railings to provide assistance for people entering or exiting the water. Vehicles, such as ambulances, are also provided with hand railings to provide a gripping surface for the people using the vehicle. Typically, such railings are extruded shapes, such as a circular tube or a ribbed ornate shape, and are constructed from a durable metal, such as stainless steel.

Such typical hand railings, however, do not provide a positive gripping surface which would still further assist in the corresponding human activity associated with the hand railing, particularly in activity normally associated with the handicapped. Furthermore, a positive gripping, undulating surface would not be conducive to extruded manufacture. Elastomeric grips, such as bicycle grips, have been provided to be mounted on tubing members to facilitate gripping thereof; however, such grips are normally limited to the very ends of the tubing member and cannot provide a positive gripping surface along the intermediate portions thereof.

Accordingly, it would be desirable to provide a hand railing structure that would provide a positive gripping surface along substantially the entire longitudinal length thereof. Since such a hand railing would not be conducive to manufacture by extrusion, a method of manufacture and tooling to be used in the manufacture would also be desirable.

SUMMARY OF THE INVENTION

It is an object of this invention to overcome the disadvantages of the prior art by providing a hand railing having a plurality of generally uniformly spaced indentations on one surface extending along the longitudinal length thereof.

It is another object of this invention to provide finger-sized indentations in the underside of a hand railing along substantially the entire length thereof.

It is a feature of this invention that the hand railing provides a positive gripping surface throughout the length of the hand railing.

It is an advantage of this invention that the hand railing is constructed out of a durable metal.

It is another feature of this invention that the hand railing can be mounted in different ways to permit use thereof in a variety of installations.

It is another advantage of this invention that the hand railing can be manufactured from standard tubing stock.

It is still another advantage of this invention that the hand railing can have a generally tear-drop cross-sectional configuration to conform to the grip thereof by a human hand.

It is still another feature of this invention that the indentations have a compound configuration formed from first and second arcuate shapes oriented perpendicularly and oppositely to match the shape of the human finger.

It is still another object of this invention to provide a method of manufacture of a hand railing having a plurality of indentations extending substantially uniformly along the longitudinal length thereof.

It is yet another object of this invention to provide a manufacturing process to form the indentations in standard tubing stock without collapsing the tubing.

It is yet another feature of this invention to provide a method of manufacture of a hand railing having a series of indentations in the underside thereof in which the indentations are formed in alternating fashion.

It is yet another advantage of this invention that forming indentations in an alternate fashion does not cause the tubing stock to collapse during the manufacturing process.

It is a further feature of this invention to provide a method of manufacture of a hand railing having a series of indentations in the underside thereof in which the indentations are formed in a sequential fashion.

It is a further advantage of this invention that forming indentations in a sequential fashion does not cause the tubing stock to collapse during the manufacturing process.

It is still a further feature of this invention that the indentations may be formed in both a alternating and sequential fashion.

It is yet another object of this invention to provide a tool to be used in the manufacture of a hand railing having a plurality of indentations along one surface thereof extending along substantially the entire longitudinal length thereof.

It is yet a further feature of this invention that the tool is provided with a plurality of uniformly, longitudinally spaced forming punches that are engageable with the tubing stock supported in the body cavity to form the indentations therein.

It is still a further advantage of this invention that the forming punches are individually movable relative to the other forming punches so as to be conducive to manufacture by using either the alternating or sequential methods of forming the indentations.

It is yet a further advantage of this invention that the forming punches are biased toward a non-engaging position in which the forming punches are withdrawn from the body cavity supporting the tubing stock.

It is yet another feature of this invention that the forming punches can be provided with a tip portion have a compound configuration formed by the combination of a first arcuate concave shape and a second arcuate convex shape oriented generally perpendicularly to the first arcuate shape.

It is still another feature of this invention that the body portion of the tool is bifurcated to facilitate the introduction of the tubing stock into the body cavity.

It is yet another object of this invention to provide a rigid hand railing having uniformly spaced indentations along its longitudinal length and a method and tool for manufacture thereof, which is durable in construction, inexpensive of manufacture, carefree of maintenance, facile in assemblage, and simple and effective in use.

These and other objects, features and advantages are accomplished according to the instant invention by providing a rigid hand railing having a plurality of compound indentations formed in the underside thereof to facilitate gripping thereof by a human hand. A method of manufacture of such a hand railing is also disclosed wherein a tool having a plurality of individually movable forming punches to be driven into preformed tooling stock is used to form the indentations in one side of the tubing stock. Each forming punch is provided with a tip portion having a compound shape formed from two perpendicularly oriented and oppositely disposed arcuate shapes. The forming punches are to be alternatively or sequentially driven into the tubing stock to form the indentations.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 3:
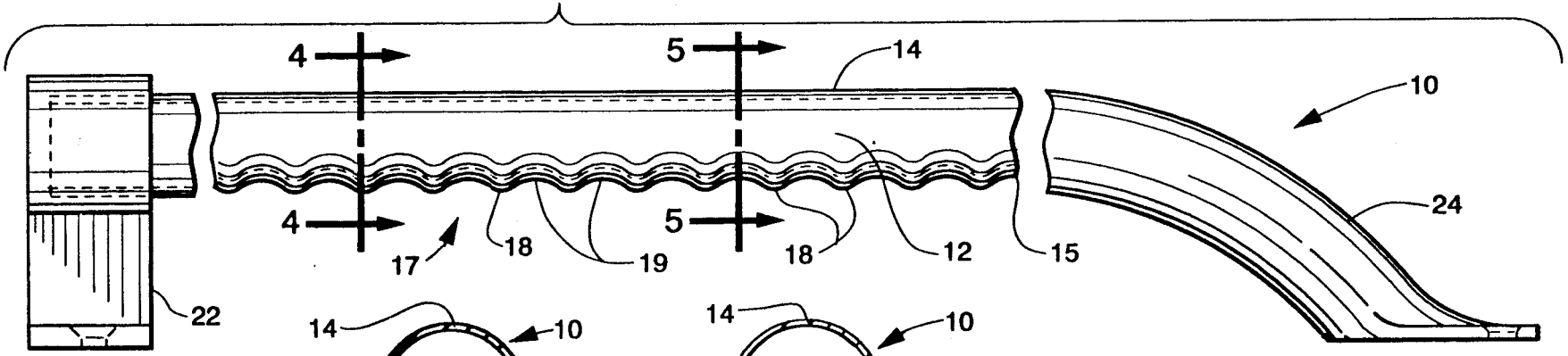
FIG. 3 is a side elevational view of the hand railing manufactured in accordance with the principals of the instant invention, two representative mounting flanges being depicted at the opposing ends thereof, sections of the hand railing being broken away to indicate an indefinite length thereof.
Figure 5:
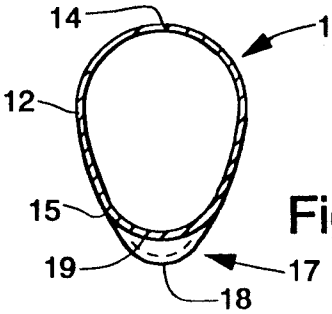
FIG. 5 is a cross-sectional view of the hand railing taken along lines 5—5 of FIG. 3 to depict the cross-sectional configuration of the hand railing through one of the formed indentations.
Figure 4:
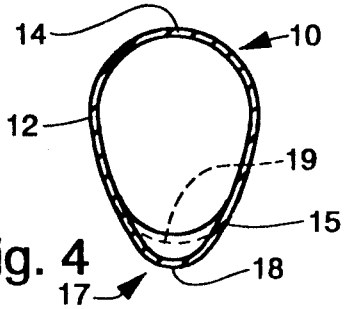
FIG. 4 is a cross-sectional view of the hand railing taken along lines 4—4 of FIG. 3.
Figure 6:
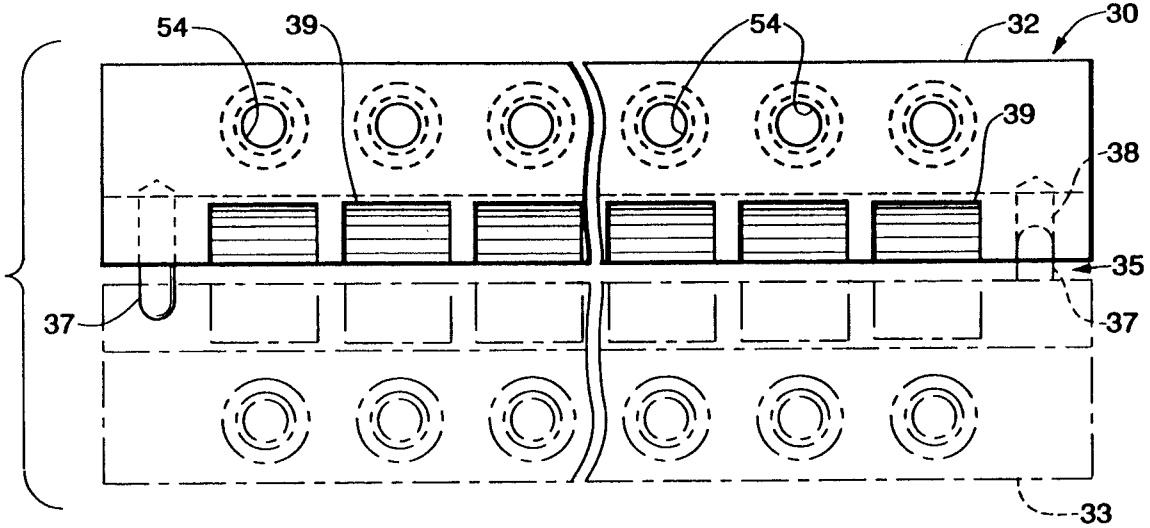
FIG. 6 a top plan view of one half of the tool used in the manufacture of the hand railing shown in FIGS. 3—5, the opposing half of the tool being shown in phantom, portions of the tool being broken away for purposes of clarity.
Figure 7:
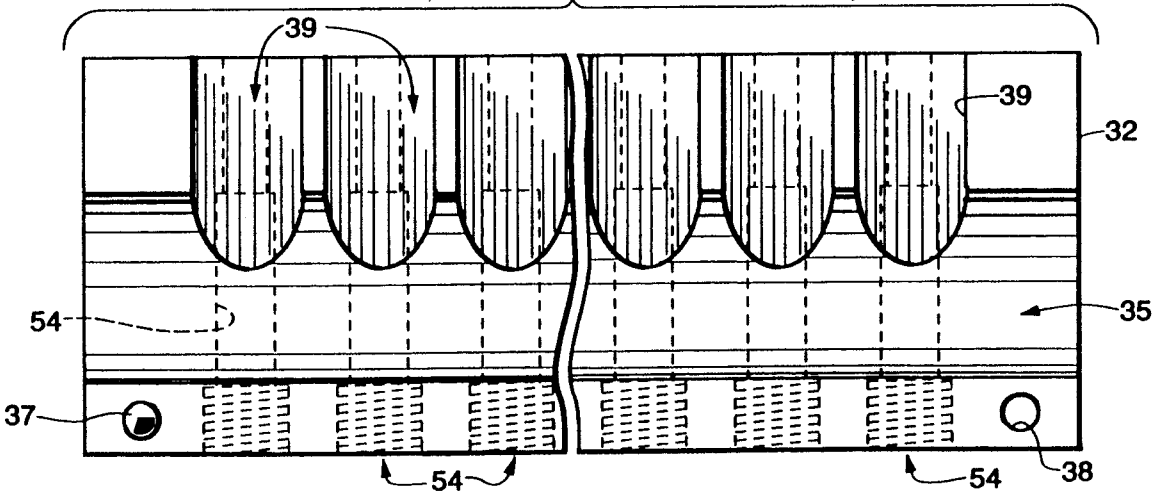
FIG. 7 is a side elevational view of the tool shown in FIG. 6, looking at the parting line of the tool, depicting the cavity in which the tubing stock is supported.
Figure 8:
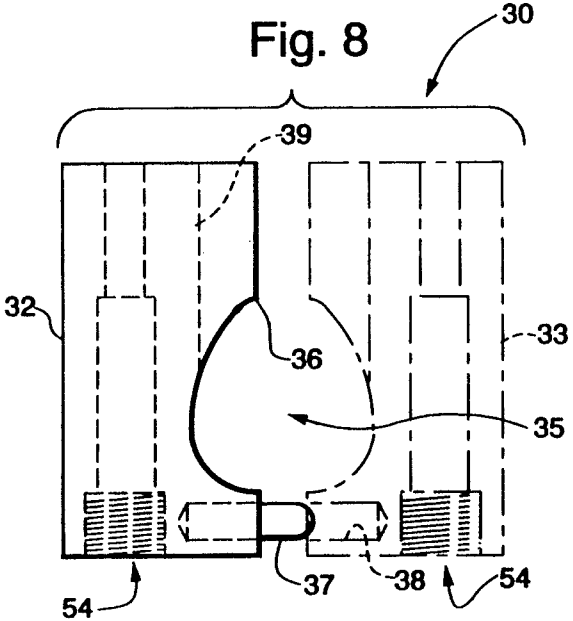
FIG. 8 is an end elevational view of the tool shown in FIG. 6, the opposing half of the tool being shown in phantom.
Figure 9:
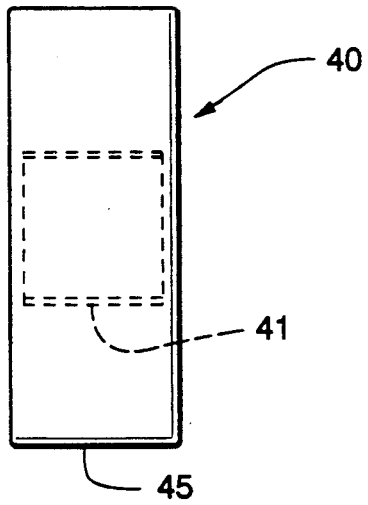
FIG. 9 is a top plan view of a T-shaped forming punch insertable as a key within the tool shown in FIG. 6.
Figure 10:
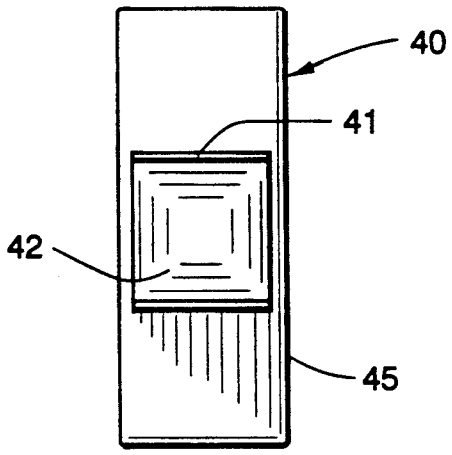
FIG. 10 is a bottom plan view of the forming punch shown in FIG. 9.

Referring now to FIGS. 3–5, an improved hand railing can best be seen. The metal hand railing 10 is formed from an elongated body portion 12 which, as can best be seen in FIGS. 4 and 5, has a oval or tear-drop cross-sectional shape, wherein the top portion 14 has a greater radius of curvature and is wider than the lower apex portion 15. The lower apex portion 15 is formed with a series of indentations 17 substantially equally spaced along the longitudinal length of the body portion 12. Each indentation 17 creates alternating ridges 18 and valleys 19 to form finger-sized gripping surfaces to facilitate gripping of the hand railing 10.

The metal hand railing 10 is formed by a process described in greater detail below and can be formed in substantially any given length for use in a multitude of places. The elongated body portion 12 is adapted to be connected to a variety of mounting fixtures, such as representatively shown in FIG. 3 by the perpendicularly extending wall bracket 22 which would keep the body portion 12 spaced outwardly at any selected orientation from a wall surface or the like, and by the curved flush-mount adaptor 24 that can be fixed permanently, such as by welding, to the body portion 12 to form a hand railing traditionally used in swimming pools or on vehicles like ambulances, depending on the selected length and application of the hand railing 10. Such hand railings would be particularly adapted for use as "handicap railing" as traditionally used in handicap facilities.

Referring now to FIGS. 6–14, the manufacturing tool or die 30 can best be seen. The tool 30 is constructed in opposing first and second mating halves 32, 33, which when assembled in the manner depicted in FIGS. 6 and 8 define an oval or tear-drop shaped cavity 35 extending longitudinally therebetween. The shape of the cavity 35 corresponds identically to the cross-sectional shape of the body portion 12 of the hand railing 10 to be manufactured from the stock tubing shown in FIGS. 1 and 2. The tool 30 includes locator dowels 37 and opposing sockets 38 in a conventional manner to position the respective halves 32, 33 of the tool 30 in proper orientation during the manufacturing process.

Longitudinally spaced along the length thereof, the tool 30 includes a plurality of passageways 39 extending vertically into the apex portion 36 of the cavity 35. A key-like forming punch 40, having a T-shaped configuration, is positioned in each of the passageways 39 for insertion into the cavity 35. The forming punch 40 is best seen in FIGS. 9–12 and includes an elongated shank portion 41 and an integrally formed, perpencicularly oriented head portion 45 extending outwardly on opposing sides of the shank portion 41 to form the T-shaped configuration. The shank portion 41 terminates in a tip portion 42 engageable with the tubing stock placed in the cavity 35 during the manufacturing process described in greater detail below.

Figure 11:
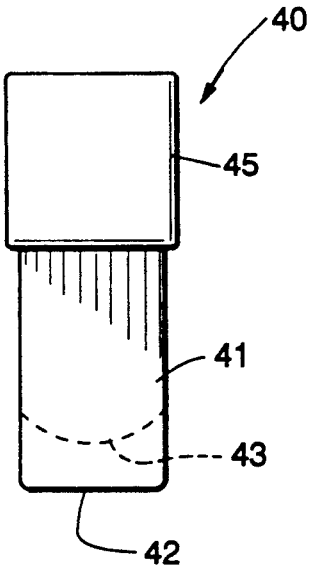
FIG. 11 is a side elevational view of the forming punch shown in FIGS. 9 and 10 taken longitudinally of the T-shaped configuration.
Figure 12:
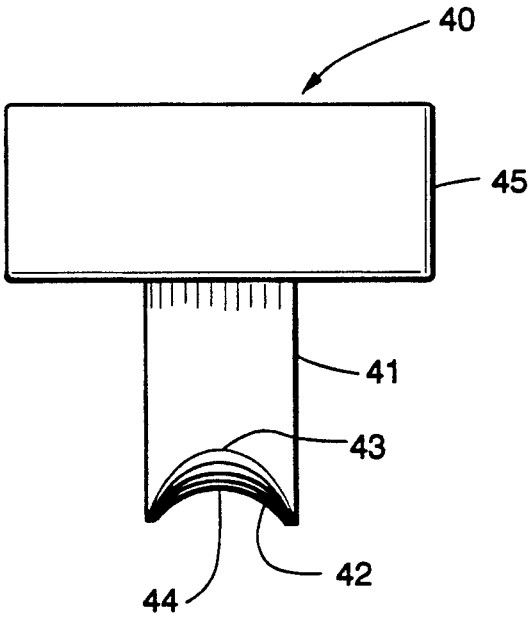
FIG. 12 is a side elevational view of the forming punch shown in FIGS. 9 and 10 taken transversely of the T-shaped configuration, depicting the side elevational view perpendicular to the view of FIG. 11.

The tip portion 42 has a compound curvature formed from a combination of a first convex curved surface 43, as seen from the orientation of the head portion 45, which is oriented perpendicularly to the elongated axis of the head portion 45, as depicted best in FIG. 11, and a second concave curved surface 44, relative to the same orientation from the head portion 45, except that the second concave curved surface 44 is oriented parallel to the elongated axis of the head portion 45. The compound shape of the tip portion 42 creates the finger-shaped indentations 17 during the manufacturing process described below.

Figure 13:
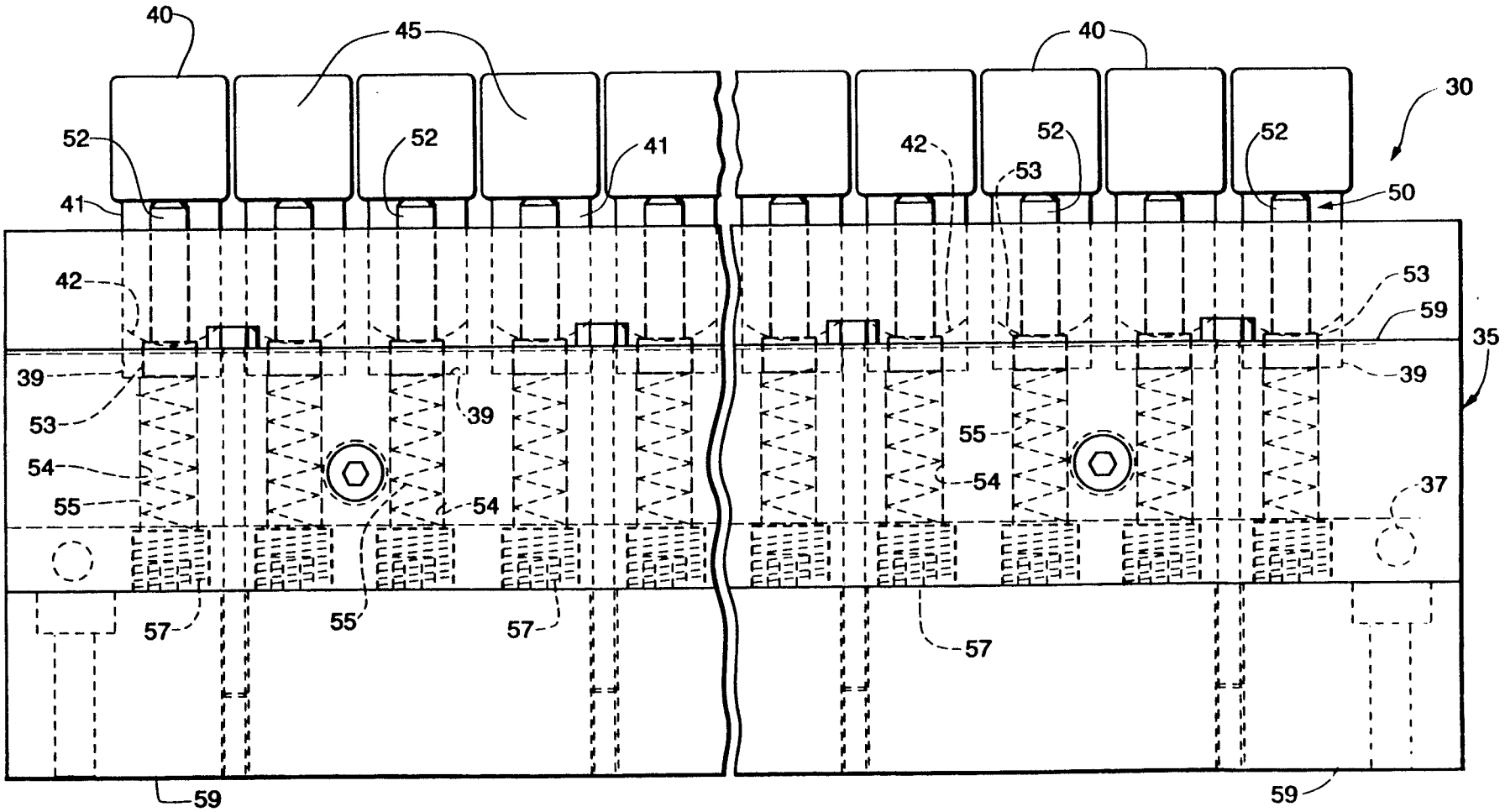
FIG. 13 is a side elevational view of the tool shown in FIGS. 6–8 with the forming punches shown in FIGS. 9–12 assembled as keys in the tool, the forming punches being positioned in a non-engaging position by the spring biasing mechanism, the central portion of the tool being broken away for purposes of clarity, the tool being positioned in a tool holder.
Figure 14:
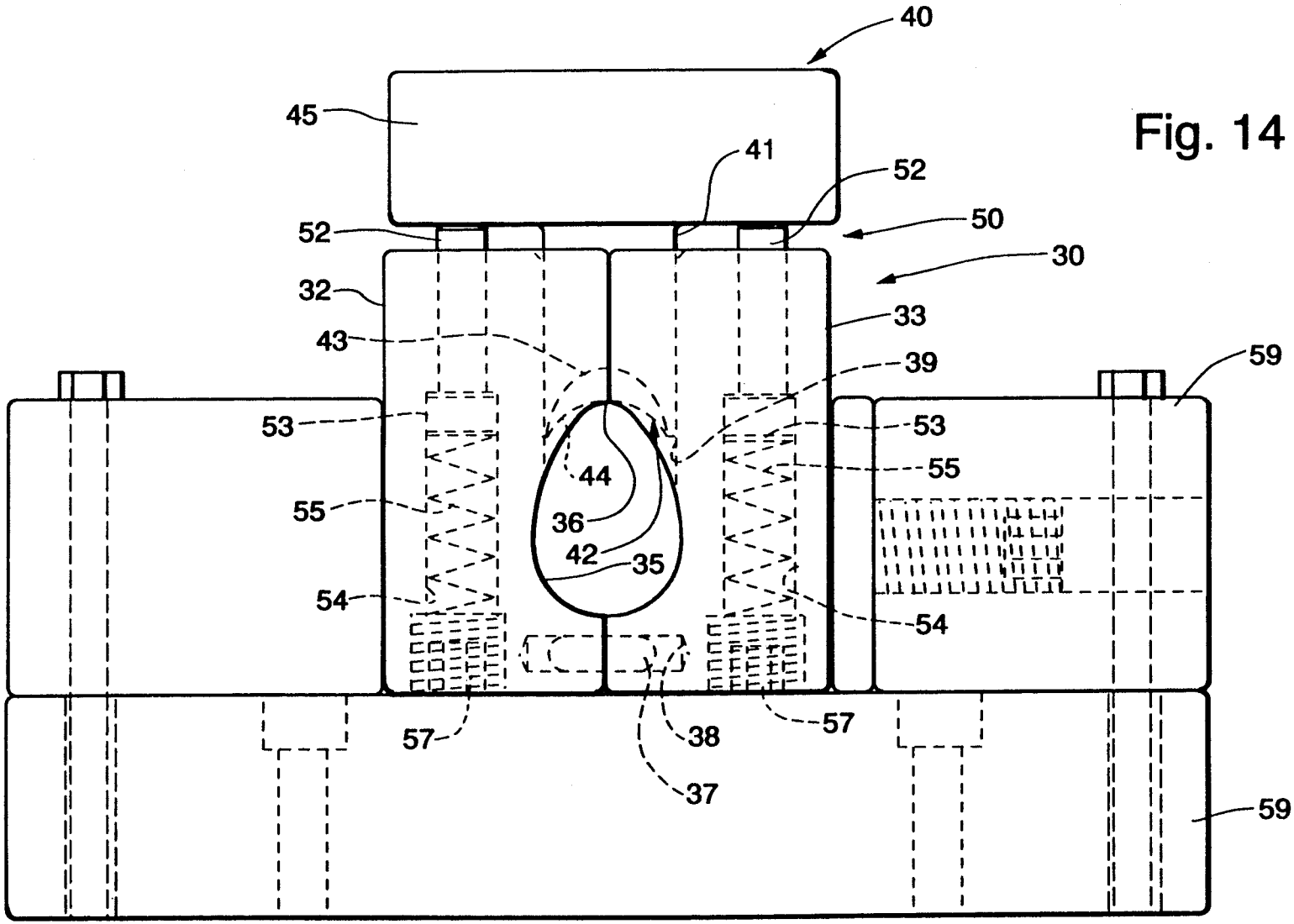
FIG. 14 is an end elevational view of the tool positioned in the tool holder shown in FIG. 13.

The tool 30 further includes a biasing mechanism 50, best seen in FIGS. 13 and 14, to engage the forming punch 40 to maintain the forming punch 40 in a position retracted from the cavity 35. The biasing mechanism 50 includes a pair of pins 52 positioned on opposing sides of the shank portion 41 to be engageable with the head portion 45 of the corresponding forming punch 40. Each pin 52 is generally vertically movable within a corresponding countersunk hole 54 formed in the respective halves 32, 33 of the tool 30 and includes an enlarged head 53 that cannot be withdrawn from the corresponding countersunk hole 54, except through the bottom thereof.

The biasing mechanism further includes a spring 55 positioned within the countersunk hole 54 below the corresponding pin 52 to urge the pin 52 upwardly toward the head portion 45 of the forming punch 40. A threaded plug 57 closes the bottom of each countersunk hole and provides a base against which the corresponding spring 55 can compress when overcome by an external force pressing the forming punch 40 into the cavity 35 for engagement with the tubing stock therewithin. In a normal rest position, each forming punch 40 is moved upwardly into the aforesaid retracted position to the extent permitted by the limits imposed by the enlarged head 53 engaging the countersunk hole 54. The length of the shank portion 41 is sized to the depth of penetration into the cavity 35 desired to form the indentations 17 so that the head portion 45 acts as a stop preventing further movement of the forming punch 40 into the cavity 35.

The process of manufacturing the hand railing 10 is preceded by assembly of the tool 30. The pins 52 are inserted through the bottom of the corresponding countersunk holes 54 in such a manner as to protrude outwardly through the holes 54 until limited by the inability of the enlarged head 53 to pass through the smaller top opening. A spring 55 is inserted into each countersunk hole 54 to contact the enlarged head 53 of the corresponding pin 52. The plug 57 is then threaded into the bottom of the hole 54 until recessed entirely into the hole 54 to capture the spring 55 and pin 52 therewithin. The two halves 32, 33 of the tool 30 can be fastened together and the forming punches 40 inserted through the passageways 39, which will be retained in the aforementioned retracted position due to the engagement thereof by the biasing mechanism 50. Finally, the tool 30 is mounted in a standard tool holder 59 as shown in FIGS. 13 and 14.

Figure 1:
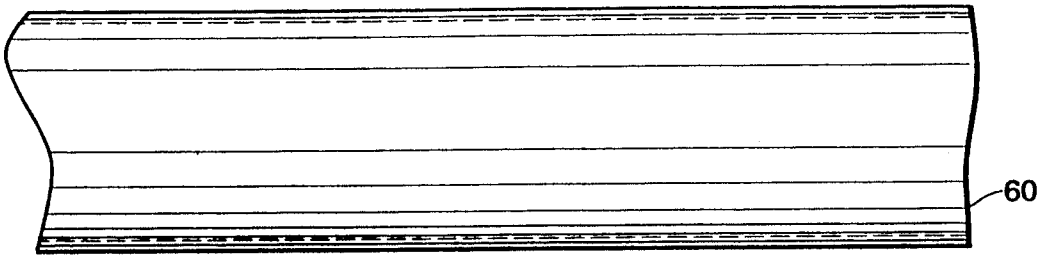
FIG. 1 is a side elevational view of a section of tubing stock from which the instant invention is manufactured.
Figure 2:
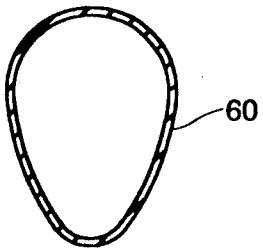
FIG. 2 is a cross-sectional view of the tubing stock shown in FIG. 1.

Standard oval or tear-drop shaped tubing stock 60, as depicted in FIGS. 1 and 2, which may be previously formed in a conventional manner from round tubing stock, can then be drawn into the cavity 35 from the open end thereof with the apex portion thereof oriented upwardly for engagement with the forming punches 40. Each forming punch 40 is individually movable between the retracted position and an engaging position in which the tip portion 42 is pressed into the tubing stock 60 to form the indentations 17. Because of the pressures required to form the indentations 17, all of the forming punches 40 cannot be depressed into the cavity simultaneously, as such action will collapse the tubing stock within the cavity. Therefore, support of the periphery of the tubing stock 60 during formation of the indentations 17 is of critical importance.

Accordingly, the indentations 17 can be formed in the tubing stock 60 by effecting through an external mechanism a depressing of the forming punches 40 sequentially from one end of the tool 30 to the other, the selected length of the shank portion 41 and the limit of the head portion engaging the tool defining the depth of the indentation 17 formed thereby. This sequential manipulation of the forming punches 40 can be accomplished by engaging the head portions 45 with a roller (not shown) by passing the roller over the tool 30 or by passing the tool 30 under the roller. Alternatively, alternate forming punches 40 could be simultaneously depressed into the tubing stock 60 to form half of the indentations 17 in one manufacturing step, after which the other alternate forming punches 40 could be depressed to form the remaining half of the indentations 17.

A further variation of the apparatus for forming the indentations would include the utilization of a specially formed roller or fluted roller (not shown) having a plurality of tip portions 42 circumferentially affixed thereto or formed as flutes into the circumference of the roller. By exposing the tubing stock 60 through a longitudinally extending opening (not shown) corresponding to the locations of the forming punches 40 along the length of the tool 30, the specially formed roller or fluted roller (not shown) could be engaged with the tubing stock 60 while supported within the tool 30 to sequentially form the indentations 17 as the roller is advanced relative to the length of the tubing stock 60. Such a mechanism is deemed equivalent to the forming punches 40 being pressed into the tubing stock 60 as described in detail above. Other similar variations as suggested herein may also be provided.

Still other combinations of steps for depressing the forming punches 40 into the tubing stock 60 can create the indentations 17 without collapsing the tubing stock 60. For example, a tool 30 having an overall length significantly less than the desired final length of the hand railing 10 could be utilized and then the tubing stock 60 would be indexed through the tool 30 after all of the indentations 17 corresponding to the tool 30 had been formed. A tool 30 with only one forming punch 40 could be utilized if the tubing stock were frequently indexed through the tool at requisite intervals.

It will be noted that each indentation 17 is formed with a compound curved shape corresponding to the shape of the tip portion 42 of the forming punches 40. Each indentation 17 has a first curved or arcuate surface oriented parallel with the longitudinal length of the hand railing and a second curved or arcuate surface oriented generally perpendicularly relative to the first arcuate surface. The resultant compound shape conforms substantially to fingers gripping around the railing 10. The first curved surface is concave toward the top portion 14 of the hand railing 10, while the second arcuate surface is convex relative to the top portion 14.

For installations such as at swimming pools and on vehicles, etc., the tubing stock 60 is preferably stainless steel; however, other metallic materials can be used to correspond to other appropriate installations. Once the hand railing 10 is formed, appropriate mounting flanges or adapters, such as shown in FIG. 3 at 22, 24, may then be connected permanently or detachably to permit proper installation of the hand railing in the desired manner. A hand railing formed in the above-described manner can provide a more positive gripping action than heretofore known for metallic hand railings. The oval or tear-drop shape of the hand railing 10 conforms to the shape of the hand, while the indentations in the lower side thereof conform to the shape of human fingers, thereby providing an improved grab rail for use in any installation where greater gripping action is required.

The manufacturing process described above would also be particularly adapted to use with "rigidized tubing," made from sheet metal formed with a non-slip surface and welded into a cylindrical tube shape. Such tubing stock would then have an embossed textured, non-slip surface extending substantially around the entire external circumference thereof. When a hand railing 10 is manufactured from such textured tubing, the surface thereof would be further adapted for non-slip gripping. Accordingly, any references herein to a smooth top surface 14 is intended to reflect a non-indented surface, as compared to the apex surface 15, rather than having a non-textured surface, as hand railing 10 made from embossed textured tubing would have a corresponding textured top surface. Other manufacturing precesses, such as sand blasting, can also be utilized to modify the peripheral surface of the hand railing 10 within the principals and scope of this invention.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

Having thus described the invention, what is claimed is:

1. A hand railing comprising a rigid, elongated body portion terminating in first and second spaced apart ends defining a longitudinal length of said body portion, each said end being adapted for attachment to a mounting connector, said body portion further having a first surface and a circumferentially opposed second surface, said second surface having a plurality of longitudinally spaced indentations to facilitate gripping thereof, said indentations being generally uniformly formed and spaced along the major portion of said longitudinal length and terminating along a line generally parallel to said first surface.

2. The hand railing of claim 1 wherein said first surface is substantially smooth along the longitudinal length thereof.

3. The hand railing of claim 1 wherein each said indentation is formed with a first arcuate portion oriented parallel with said longitudinal length and a second arcuate portion oriented generally perpendicularly relative to said first arcuate portion.

4. The hand railing of claim 3 wherein said body portion has a generally uniform cross-sectional configuration along the longitudinal length thereof, said cross-sectional configuration having a first radius of curvature corresponding to said first surface and a second radius of curvature corresponding to said second surface, said first radius of curvature having a greater magnitude than said second radius of curvature causing said cross-sectional configuration to correspond to a tear-drop shape.

5. The hand railing of claim 4 wherein said indentations have a size corresponding to the fingers of an adult human.

6. The hand railing of claim 4 wherein said first arcuate portion is concave relative to the first surface of said body portion, said second arcuate portion being convex relative to said first surface of said body portion.

7. A hand railing having a rigid, elongated body portion terminating in first and second spaced apart ends defining a longitudinal length of said body portion, each said end being adapted for attachment to a mounting connector, said body portion further having an upper surface and a circumferentially opposed lower surface, comprising:

a generally smooth upper surface extending along said longitudinal length;

a plurality of longitudinally spaced indentations formed in said lower surface to facilitate gripping thereof, said indentations being generally uniformly spaced along the longitudinal length of said body portion, and terminating along a line generally parallel to said upper surface; and each said indentation with a first arcuate portion oriented parallel with said longitudinal length and a second arcuate portion oriented generally perpendicularly to said first arcuate portion, said first arcuate portion being concave relative to said upper surface of said body portion, said second arcuate portion being convex relative to said upper surface of said body portion.

8. The hand railing of claim 7 wherein said body portion has a generally uniform cross-sectional configuration along the longitudinal length thereof, said cross-sectional configuration having a first radius of curvature corresponding to said upper surface and a second radius of curvature corresponding to said lower surface, said first radius of curvature having a greater magnitude than said second radius of curvature causing said cross-sectional configuration to have a tear-drop shape.

9. A hand railing comprising:

a rigid, elongated body portion terminating in first and second spaced apart ends defining a longitudinal length of said body portion, said body portion further having a first surface and a circumferentially opposed second surface, said second surface having a plurality of longitudinally spaced indentations to facilitate gripping thereof, each said indentation being formed with a first arcuate portion oriented parallel with said longitudinal length and a second arcuate portion oriented generally perpendicularly relative to said first arcuate portion, and said body portion having a generally uniform cross-sectional configuration along the longitudinal length thereof, said cross-sectional configuration having a first radius of curvature corresponding to said first surface and a second radius of curvature corresponding to said second surface, said first radius of curvature having a greater magnitude than said second radius of curvature causing said cross-sectional configuration to correspond to a tear-drop shape.

10. The hand railing of claim 9 wherein said first surface is substantially smooth along the longitudinal length thereof.

11. The hand railing of claim 10 wherein said first arcuate portion is concave relative to the first surface of said body portion, said second arcuate portion being convex relative to said first surface of aid body portion.

12. The hand railing of claim 11 wherein each said end is adapted for attachment to a mounting connector.

13. The hand railing of claim 9 wherein said indentations have a size corresponding to the fingers of an adult human

14. The hand railing of claim 9 wherein said indentations are generally regularly formed along said longitudinal length.

* * * * *